299-13
5/29/84 XR 4,451,088

United States Patent [19]

Wisseroth

[11] 4,451,088

[45] May 29, 1984

[54] GAINING ACCESS TO VERY DEEP COAL SEAMS BY CARRYING EXPLOSIVE IN DENSITY CONTROLLED FLUID

[75] Inventor: Karl Wisseroth, Ludwigshafen, Fed. Rep. of Germany

[73] Assignee: BASF Aktiengesellschaft, Fed. Rep. of Germany

[21] Appl. No.: 348,200

[22] Filed: Feb. 12, 1982

[30] Foreign Application Priority Data

Mar. 6, 1981 [DE] Fed. Rep. of Germany ..... 3108425

[51] Int. Cl.[3] ..... E21C 37/12

[52] U.S. Cl. ..... 299/11; 299/13; 299/18; 166/299

[58] Field of Search ..... 299/13, 17, 18, 11, 299/4; 166/299

[56] References Cited

U.S. PATENT DOCUMENTS

| | | | |
|---|---|---|---|
| 3,072,054 | 1/1963 | Ashbrook | 175/3.5 |
| 3,874,733 | 4/1975 | Poundstone et al. | 299/17 |
| 3,964,792 | 6/1976 | Archibald | 299/13 |
| 4,044,563 | 8/1977 | Hurst et al. | 299/11 X |

*Primary Examiner*—Ernest R. Purser
*Attorney, Agent, or Firm*—Keil & Witherspoon

[57] ABSTRACT

A process for gaining access to the coal of very deep seams, and for extracting this coal with the aid of a conveying liquid, which is fed to the seams via boreholes and is thence brought back again to the surface with coal which has been detached, wherein agents for detaching and breaking up the coal are admixed to the liquid.

10 Claims, 2 Drawing Figures

Figure 1:
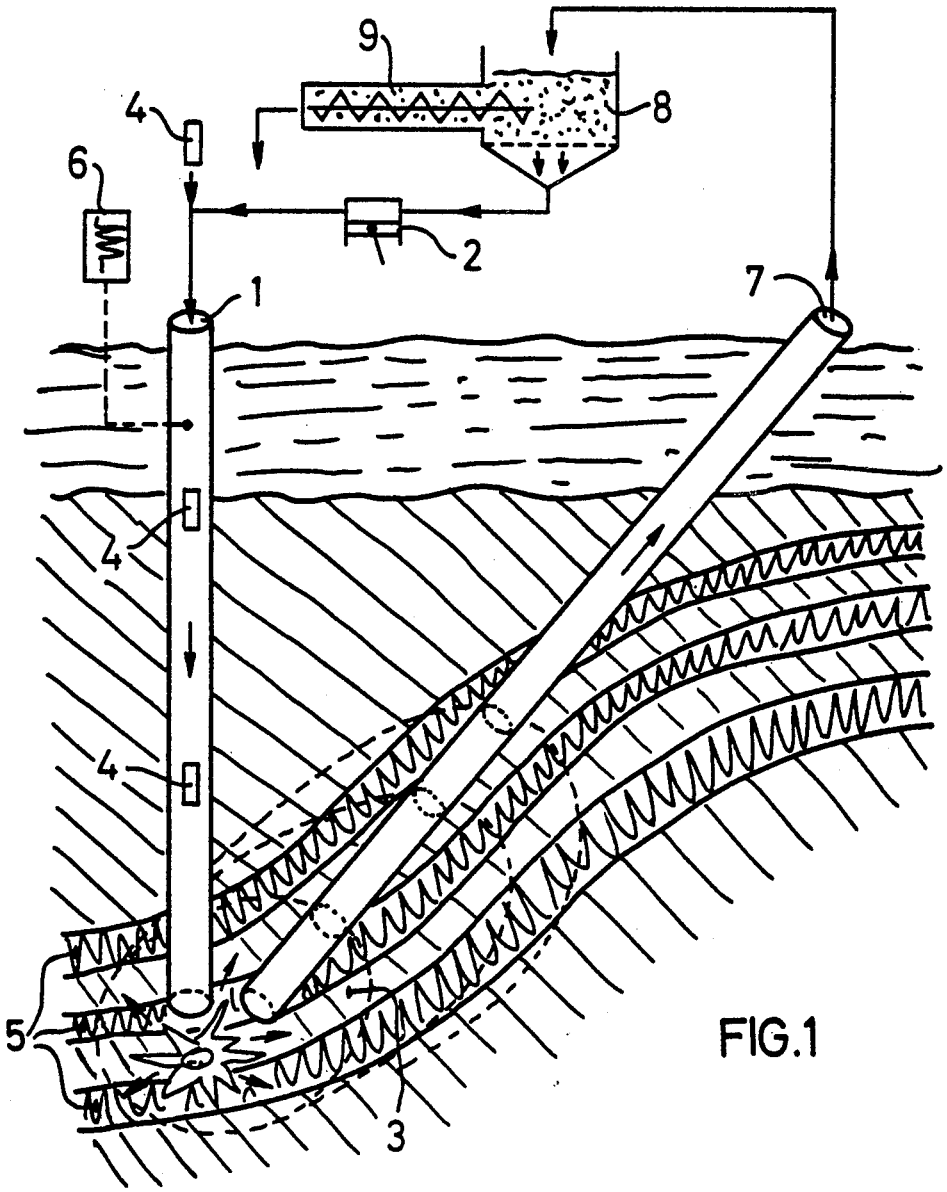

GAINING ACCESS TO VERY DEEP COAL SEAMS BY CARRYING EXPLOSIVE IN DENSITY CONTROLLED FLUID

The invention relates to a process for gaining access to the coal of very deep seams, and for extracting this coal after detonating explosives.

Coal, including both lignite and hard coal, is won by direct open cast working, or is mined from greater or lesser working depths. In the latter case, penetration to greater depths is restricted by the temperature, which increases with the depth (an average increase being approximately 3° C. per 100 meters of depth). At rock temperatures in the region of 50° C. and above, conventional mining operations cease to be possible. Modified air-supply installations, or the use of very expensive cooling units at the face, allow the working depths to be increased a little farther, but the limit of accessibility in mines in the Ruhr region, for example, currently lies at approximately 1,200 m.

However, the bulk—approximately 80%—of the central European hard coal, which is present in very great abundance, lies at depths of from 1,500 to 2,000 m, and under the North Sea even as deep as approximately 5,000 m.

The strained energy situation in recent years, in particular in the highly industrialized countries, has prompted a succession of attempts to render these hitherto untapped energy reserves available. Several underground gasification processes have been developed. In addition to these, consideration has been given to extracting the coal itself from these great depths. The plan is to force a heated solvent, for example anthracene oil, under high pressure, into the mineral deposit, via boreholes, so that the coal disintegrates into small particles, some of it being dissolved, and can be pumped, with the solvent, to the surface. The coal is then obtained by working up the mixture.

A procedure has also been disclosed wherein chemical comminution of the coal is carried out at the face, using liquid chemicals, for example liquid ammonia. However, the success of this technique is very dependent on the content of impurities in the coal, so that it is not of general usefulness.

It is an object of the present invention to provide a process for gaining access to and extracting the coal of very deep deposits, of the type initially described, which process permits efficient and economical working.

I have found that this object is achieved, according to the invention, by a process wherein an explosive and means for its detonation are fed to the region of the seams through which liquid is flowing and the pieces of coal detached from the seams during blasting are conveyed to the surface by a liquid having a density no lower than that of the coal, but lower than that of the pieces of rock which have been detached at the same time.

According to a further feature of the invention, the explosive required for blasting in the seams, and the means for its detonation, are fed to the seams with the stream of liquid.

In comparison to the conventional working technique involving tunneling, the coal extraction procedure according to the invention, involving the continuous loosening of the coal by blasting, has the advantage of not leaving voids in the rock. Such voids necessitate extensive shoring-up in the tunnel, not least in order to prevent, or limit, possible surface damage caused by subsidence. In contrast, in the case of the present extraction technique, all sections of the mine, ie. the boreholes for feeding in the conveying liquid and for bringing out the coal with the latter, as well as the cavern in the seam, in which the breaking operation is effected by blasting, are completely filled with material.

Further details and advantages of the invention are evident from the general description which follows.

The coal of very deep seams can be brought to the surface by means of a conveying liquid when an explosive blast is set off, in the coal-bearing stratum, in an underground cavern through which the liquid is flowing, the blasting causing the coal to be splintered off and broken up. In this process, the coal is brought out to the surface with the conveying liquid, because its density is lower than that of the conveying liquid. During the flow-transportation, separation from rock which has been blasted off and broken up is simultaneously effected, as the rock has a higher density than the coal. On the surface, the coal, which is usually in fine pieces, is separated from the conveying liquid by screening-off, the conveying liquid then being piped back underground to be reused. The stream of conveying liquid, which is fed back to the coal-bearing strata, also serves to transport the explosive, which is to be detonated at the face, and to solid stow the strata which have been worked out, in order to refill the voids which are produced.

A certain quantity—approximately 1 to 2 percent by weight—of substances, which are admixed to the conveying liquid in order to adjust its density, adheres to the coal which has been separated from the conveying stream by screening. These substances can either easily be removed by washing with water, or be left on the coal, after evaporation of a proportion of the solvent, usually water, the reactivity during subsequent coal gasification being increased if calcium chloride is used.

I have found that calcium chloride is particularly suitable for adjusting the density of a conveying liquid to approximately 1.35 to 1.40 g/cm$^3$, primarily to render hard coals floatable (recently formed hard coals: density= 1.25 to 1.35 g/cm$^3$, bituminous and non-bituminous coals: density=1.30 to 1.40 g/cm$^3$). However, other substances are also suitable for obtaining concentrated aqueous solutions of the relative density required, for example sodium sulfate, magnesium chloride, or zinc sulfate.

By weight, the quantity of conveying liquid required is about the same as the quantity of coal to be conveyed. The generally high integrity of the deep geological strata limits the loss of conveying liquid, resulting from occasional seepage, to an acceptable amount.

For blasting, it is possible to employ the safety explosives usually used in mining, eg. ammonites, or higher-energy explosives, for instance cyclonite, dynamite or blasting gelatin, since these explosives produce smaller blast fragments than do the slow-reacting ammonites. The danger of fire-damp, usual in conventional mining, does not exist in the present extraction procedure, since the blasting operations are carried out exclusively under water or in aqueous solutions. During the blast, the conveying liquid serves to transmit a shock wave onto the coal which is to be broken up. Tests, under comparable blasting conditions, have shown that coal can be more easily broken up than the accompanying rock. In this process, the mechanical shock correlates completely with the thermal shock which can be generated by impressing a suitably high temperature gradient on a sample of coal or rock. For example, the following results were obtained on throwing pre-heated test pieces into liquid nitrogen: coal and rock, in particular sandstone and/or coal slate, originally at room temperature, do not shatter and moreover show hardly any cracking. Coal pre-heated to 200° C. shatters to form small particles, while a rock sample pre-heated to 200° C. does not shatter. After pre-heating to 300° C., the coal shatters to form fine powder, while the rock still does not shatter.

Comparatively little explosive is required to blast the coal loose and to break it up. As found in tests, from 1 to 5 kg of explosive is needed per tonne of coal, depending on the shattering power of the explosive.

The explosive which is fed with the conveying liquid into the caverns in the seams can be set off by means of delayed detonators or, alternatively, by over-pressure, with or without a delay. Under some conditions, the explosive which is to be transported by the conveying liquid requires ballasting to add weight, depending on the density of the explosive employed (ammonite: 1.30 g/cm$^3$; cyclonite: 1.70 g/cm$^3$).

The voids formed by the extraction of the coal are initially still filled with conveying liquid, so that they can finally be closed again by solid stowing. Suitable debris are any rock-like materials in a comminuted condition and/or materials having a higher density than that of the conveying agent. It is thus possible to use, for example, broken rock, sea sand, or even building rubble and heavy garbage residues.

The conveying liquid, piped to great depths, undergoes considerable geothermal heating. Temperatures of about from 80° to 100° C. can prevail at a depth of only 2,000 m. Moreover, a portion of the detonation energy of the explosive is converted into heat, causing further, albeit slight, heating of the conveying medium. The liquid arriving from the depths will thus have a higher temperature and, consequently, a lower density than the liquid flowing in. Overall, a thermal siphon effect will come into action between two boreholes which connect an underground cavern to the surface. This effect means that there will be a reduction in the power load on the mechanical pumping devices for the circulatory flow of the liquid through the underground cavern. It is possible at the same time to abstract energy from the liquid/-coal stream at the surface, by cooling. In the case of a conveying rate of, for example, 100 tonnes/h of coal, an additional heat output of approximately 5 megawatts is obtained as a result of the heating of the stream of conveying liquid in the deep strata, although this heat is at a comparatively low temperature (approximately 100° C.).

The distance to which the seam is worked by blasting can be substantially increased if the explosive charges are carried to the seam which is to be worked with the aid of additional propelling charges—a kind of underwater rocket. For this purpose, this explosive charge is automatically brought by its keel arrangement into that position of its propulsion direction which defines the angle of inclination, this positioning taking place during or after its transportation to its operating level by the conveying liquid. This propulsion direction will be predominantly within a virtually horizontal plane. The propulsion charge is ignited by means of an over-pressure detonator, with or without an ignition delay, and the explosive charge is carried to the face. Following burnout of the propulsion charge, ignition of a primer, eg. lead azide, mercury fulminate, or aluminum/barium peroxide mixture, is initiated, which finally causes the explosive charge to detonate. In a particularly advantageous embodiment the explosive charge is detonated by a percussion detonator, which can be located on the head of the propulsion charge. The underwater rocket is provided with longitudinal fins to stabilize the trajectory. For the same reason, its weight is carefully adjusted to give approximately neutral buoyancy in the transport liquid.

By introducing a hose into the borehole, it is now possible directly to reach the working face in the seam. Due to the comparatively low weight of the materials forming the hose, the latter floats upwards in the liquid-filled cavern. The circulating stream of transporting medium can be both fed in and, when laden with detached coal, conveyed back to the surface through the hose. It is generally sufficient if only the section which penetrates into the seam is made of a highly flexible material. The portion remaining in the borehole can be of rigid material—possibly even metal—which makes it easier to move this additional line.

I have in fact found that highly resilient materials, such as soft rubber, as a rule withstand the shock of the detonation without damage, even in the direct vicinity of the center of the explosion. Thus, for examle, hoses about 30 cm long, made of ordinary red soft rubber, foam rubber, plasticized polyvinyl chloride, high pressure polyethylene and polytetrafluoroethylene, were exposed to the blast of 60 grams of ammonium nitrate explosive, under water in a 12-liter hobbock. The blast completely destroyed the steel vessel whilst all the hoses remained undamaged.

The same test, carried out in the presence of broken rock and pieces of coal, showed a noticeable effect only in the case of foam rubber, in that this hose disintegrated into several parts, particularly at points at which it had been glued together end to end. Surprisingly, high pressure polyethylene and polytetrafluoroethylene showed no damage of any kind, whilst plasticized polyvinyl chloride exhibited only superficial scratches caused by splinters of rock and coal. Highly resilient and viscoelastic materials are apparently capable not only of yielding to a shock wave in a liquid medium, but also of successfully resisting the high velocity splinters of solid material.

Since the explosive required for the blasting operation is transported with the liquid which is fed to the working zone, feeding in the liquid through a hose means that the explosive also is carried direct to the face. The use of an additional rocket-like propulsion charge becomes unnecessary in this case. The risk of premature detonation of the explosive charge, which would destroy the hose, can be counteracted by appropriately delaying the detonator of the explosive charge. When the two functions, ie. the removal of the broken coal through the flexible tube and the bringing of the explosive charge to the face, are separated, eg. by using an additional propulsive charge, the risk of damage to the hose is low, particularly for the simple reason that the site of the blasting operation and the position of the hose are as a rule a considerable distance apart. At the same time, the position of the hose will never remain stationary, but will change by differing amounts from one blasting operation to the next.

A further possible method of protecting the hose from damage is to pull the hose back by a few meters immediately after the explosive has been fed to the face. Only when the blasting operation has taken place and has been observed on the surface by recording the pressure pulse is the flexible hose pushed forward again to the face, to remove the coal which has been broken up, and/or to feed in more conveying liquid, with or without more explosive. Packing material can likewise be fed in through the hose by means of the liquid, to refill the mine sections from which the coal has been cleared.

The use of hose lines considerably simplifies the extraction of the coal, in that, first, the partitioning hose enables the feeding-in and the return of the conveying liquid to occur in a single bore, and, secondly, a mineral deposit can be successfully developed to considerable distances, starting from a central bore. The considerable drilling costs incurred in the conventional in situ technique are consequently eliminated.

Figure 2:
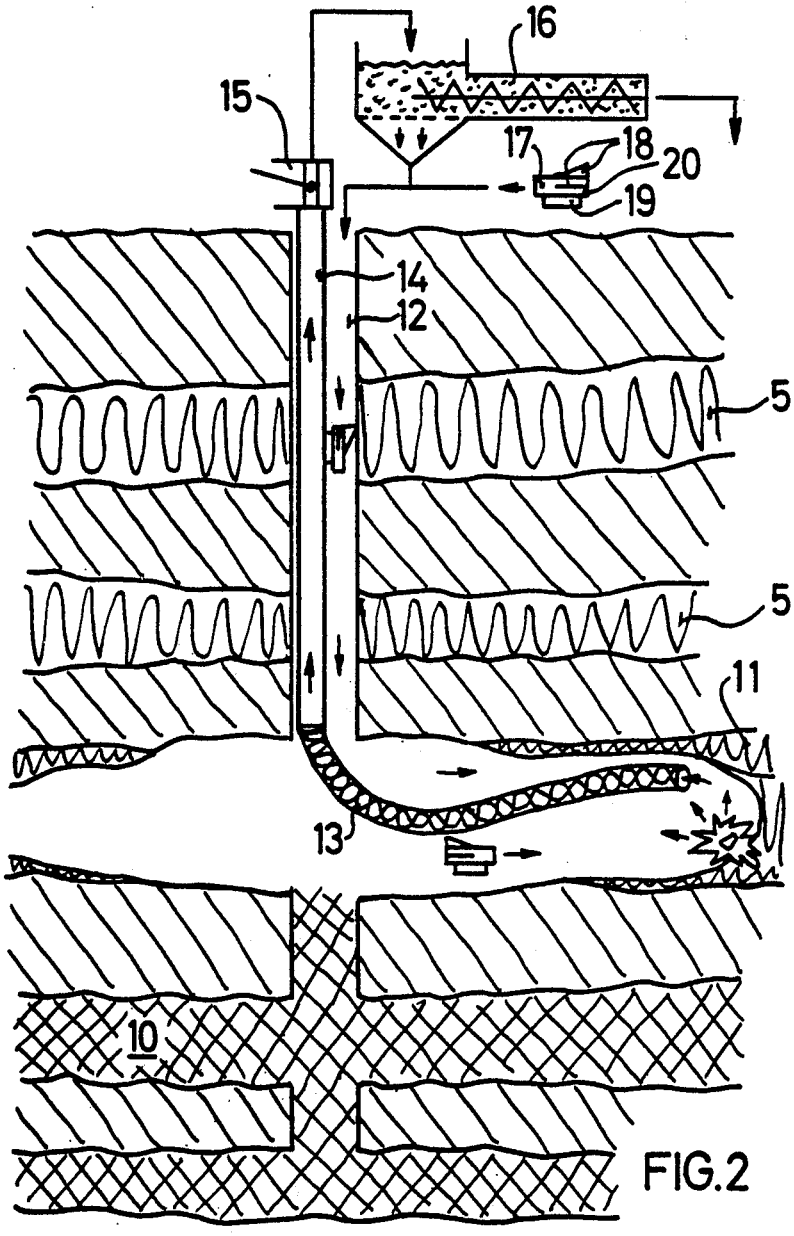

The process according to the invention is illustrated by the embodiments which are explained below, with reference to the drawing, in which FIG. 1 shows, in section, a diagrammatic access arrangement, with two boreholes, for carrying out the process in the case of undersea working FIG. 2 shows a diagrammatic sectional view of a borehole and a cavern, with a hose introduced therein.

EXAMPLE 1

A saturated aqueous calcium chloride solution is fed as the conveying liquid, at the rate of 80 tonnes per hour, into a cavern 3 in the seams 5, with the aid of a pump 2, through a borehole 1 which has a diameter of about 250 millimeters and is lined over its entire length. A cartridge 4, loaded with explosive and weighing about 120 g, is added to the stream of liquid about every 8–10 seconds, these cartridges being equipped with an overpressure detonator, so that the latter detonates the explosive charge after the cavern has been reached. The regularity of the detonations is monitored on the pressure-pulse recorder 6, which is connected at the surface to a sensor attached to the borehole liner tube. Due to their higher relative density compared to the conveying liquid, occasional "duds" remain in the cavern, and are detonated, at the latest, by the next exlosive charge.

Under the action of the continually recurring shocks, the coal which has been blasted off and broken up is separated by gravity, in the liquid, from rock broken up at the same time, and is brought to the surface with the conveying liquid, through an additional, lined borehole 7, which likewise has a diameter of approximately 250 millimeters. As the blasting of the coal progresses, and the cavern is thereby enlarged, the borehole 7 is progressively shortened. At the same time, given appropriate siting of the boreholes, the zones in which the coal is worked follow approximately the direction in which the seam runs.

On a screen 8, approximately 50 tonnes per hour of broken coal are separated from the conveying liquid, which is passed on via the pump 2 for reuse, and this coal is carried out of the circuit by a discharge device 9, eg. a screw conveyor.

The coal can be fed directly in this state to the energy-producing combustion process, or can be freed from adhering residues by washing with water and made available for other uses.

EXAMPLE 2

FIG. 2 shows a vertical section of interstratified seams in geologically stable formations, eg. the Upper Carboniferous or Permian and Zechstein formations, roughly as they are encountered in the carbonaceous rocks of the Palatinate/Saarland region. The coal is, in part, interstratified with rock, and this has hitherto interfered with its economical extraction by conventional techniques. A deep borehole of 300 millimeters diameter, extending to a depth of 3,000 meters, passes through a comparatively large number of seams having individual thicknesses from a few meters to many meters, over a total formation thickness of several hundred meters.

The working of the deposit, starting from the bottom, has progressed to a depth of 2,000 meters, and the deeper sites which have been cleared have been refilled with rock packing 10. The seam currently being worked is marked 11, the working range having been advanced to a distance of about 25 meters, approximately symmetrically to the central borehole 12. The working face, near where the seam has been cleared, is connected to a pipeline 14, which is located in the borehole, by a plasticized polyvinyl chloride hose 13 having an internal diameter of about 150 millimeters and a wall thickness of 6 millimeters. The hose and the pipeline serve to convey the worked-out and broken-up coal to the surface, with the aid of a concentrated calcium chloride solution (density = 1.40 g/cm$^3$) as the conveying liquid. Using a circulating pump 15, at a flow velocity of approximately 1.5 meters/second, about 50 tonnes per hour of broken coal are extracted and are separated from about 40 cubic meters per hour of the conveying liquid by a discharge device 16. The conveying liquid is taken back underground for reuse.

The flow direction of the conveying liquid can also, of course, be reversed, ie. the feeding liquid is piped through the hose, together with the explosive, to the face. The coal is then conveyed in the borehole, outside the hose and/or the pipeline. 835 grams of explosive 17 are added to the return stream about every half-minute. The blasting charge is carried to the face by a propelling charge of 100 grams of black powder, contained in a propulsion unit 20 equipped with longitudinal fins 18 and a keel 19, this propelling charge being ignited by an overpressure detonator with a three-second delay, and, after burnout of the propulsion unit, the blasting charge is set off by means of a detonator, composed, for example, of a barium peroxide/aluminum powder mixture; this causes renewed blasting off and breaking up of the coal. Since, in this process, the blasting charge moves away from the end of the hose, the detonation does not occur in the immediate vicinity of the tube. Moreover, the distance between the site of the explosion and the position of the hose can be increased by partially pulling back the hose before blasting and pushing it forward again after blasting, in order substantially to avoid damage to the hose from the blasting action.

On commencing a seam-blasting operation, the explosive fed in is detonated in the borehole, at the level of the seam, using an overpressure detonator with a time delay, the end of the hose remaining at a distance of some meters from the site of the blasting operation. No additional propelling charge is necessary in this case. After the detonation, the end of the hose is extended into the seam, for thorough flushing-out, thereby conveying away most of the coal which has been broken up.

I claim:

1. In an improved process for gaining access to the coal of very deep seams, and for extracting same by causing liquid to flow through a cavern in the seams, via at least one borehole, and conveying to the surface a mixture of mechanically detached coal and liquid produced in the seams during this process, wherein the improvement comprises: filling the borehole and cavern with a liquid having a density no lower than that of the coal, but lower than that of the accompanying rock, carrying an explosive and means for its detonation in the liquid toward a coal face in the seams through which liquid is flowing, detonating said explosives at the coal face to break up and detach coal and rock whereby the pieces of coal detached from the seams during blasting are conveyed to the surface by said liquid and pieces of rock which have been detached at the same time remain in the cavern.

2. A process as claimed in claim 1, wherein the explosive required for blasting in the seams, and the means for its detonation, are fed to the coal face with the stream of liquid.

3. A process as claimed in claim 1, wherein the explosive is conveyed with the aid of a propulsion charge which is ignited after reaching the cavern and carries the explosive forward to the face in the coal seam to be worked.

4. A process as claimed in claim 1, wherein the conveying liquid is fed in and/or returned to the surface via a hose, made of a highly resilient or visco-elastic material and extending to the face in the seam to be worked.

5. A process as claimed in claim 4, wherein the hose is retracted before blasting and is afterwards advanced again to the face.

6. A process as claimed in claim 4, wherein the liquid is fed into the cavern through said hose and the said explosive is carried therethrough with the flow of liquid.

7. A process as claimed in claim 1, wherein each borehole is divided into a feeding-in passage and a return passage, by a pipeline or hose inserted into the borehole.

8. A process as claimed in claim 1, wherein debris are added to the stream of liquid entering the borehole to fill up the caverns which are produced as the coal is taken away, the density of the debris being higher than that of the liquid.

9. A process as claimed in claim 1, wherein the liquid is an aqueous solution.

10. A process as claimed in claim 9, wherein the aqueous solution contains one of calcium chloride, sodium sulfate, magnesium chloride, zinc sulfate, and combinations thereof.

* * * * *